US011819052B2

(12) United States Patent
Nakano et al.

(10) Patent No.: US 11,819,052 B2
(45) **Date of Patent: *Nov. 21, 2023**

(54) FLAVOR INHALER

(71) Applicant: JAPAN TOBACCO INC., Tokyo (JP)

(72) Inventors: Takuma Nakano, Tokyo (JP); Takeshi Akiyama, Tokyo (JP); Takashi Oda, Tokyo (JP); Masaaki Suzuki, Tokyo (JP); Takayuki Nakazono, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 136 days.

This patent is subject to a terminal disclaimer.

(21) Appl. No.: 16/233,019

(22) Filed: Dec. 26, 2018

(65) Prior Publication Data

US 2019/0133176 A1 May 9, 2019

Related U.S. Application Data

(63) Continuation of application No. PCT/JP2017/023782, filed on Jun. 28, 2017.

(30) Foreign Application Priority Data

Jul. 1, 2016 (JP) ..... 2016-131585
Jul. 1, 2016 (JP) ..... 2016-131586
Jul. 1, 2016 (JP) ..... 2016-131587

(51) Int. Cl.
*A24D 1/22* (2020.01)
*A24D 3/06* (2006.01)
(Continued)

(52) U.S. Cl.
CPC ..... *A24D 1/22* (2020.01); *A24B 15/165* (2013.01); *A24B 15/167* (2016.11); *A24D 1/002* (2013.01);
(Continued)

(58) Field of Classification Search
CPC ..... A24B 15/28; A24F 47/004; A24F 47/002; A24D 1/22
See application file for complete search history.

(56) References Cited

U.S. PATENT DOCUMENTS 2,907,686 A 10/1959 Siegel
4,765,347 A 8/1988 Sensabaugh, Jr. et al.
(Continued)

FOREIGN PATENT DOCUMENTS

CN 87103178 A 11/1987
CN 88100383 A 8/1988
(Continued)

OTHER PUBLICATIONS

International Search Report for PCT/JP2017/023782 (PCT/ISA/210) dated Aug. 8, 2017.
(Continued)

*Primary Examiner* — Kelly M Gambetta
*Assistant Examiner* — Stephanie Lynn Moore
(74) *Attorney, Agent, or Firm* — Birch, Stewart, Kolasch & Birch, LLP

(57) ABSTRACT

A flavor inhaler comprising: a tubular holder that extends from a mouthpiece end to a distal end; a combustion type heat source that is provided at the distal end, contains activated carbon, and carries a first flavorant; and a flavor source that is held in the holder and carries a second flavorant, wherein the first flavorant contains at least one selected from the group consisting of anethole, 2-pinene, 3-citronellol, linalyl acetate, limonene, anisaldehyde, 4-terpineol, 2-β-pinene, jasmone, sabinene, linalool, 1,8-cineole, phenethyl alcohol, and myristicin, and the second flavorant contains at least one selected from the group consisting of α-terpinene, γ-terpinene, nerol, geraniol, and decanal.

11 Claims, 3 Drawing Sheets

(51) Int. Cl.

| | |
|---|---|
| ***A24D 3/17*** | (2020.01) |
| ***A24F 42/60*** | (2020.01) |
| ***A24B 15/16*** | (2020.01) |
| ***A24D 1/00*** | (2020.01) |
| ***A24B 15/167*** | (2020.01) |
| ***A24F 7/04*** | (2006.01) |

(52) U.S. Cl.

CPC ..... *A24D 3/06* (2013.01); *A24D 3/061* (2013.01); *A24D 3/17* (2020.01); *A24F 7/04* (2013.01); *A24F 42/60* (2020.01)

(56) References Cited

U.S. PATENT DOCUMENTS

| | | | | |
|---|---|---|---|---|
| 4,793,367 | A * | 12/1988 | Brackmann | A24C 5/1821 131/84.1 |
| 4,819,665 | A | 4/1989 | Roberts et al. | |
| 4,854,331 | A | 8/1989 | Banerjee et al. | |
| 4,966,171 | A | 10/1990 | Serrano et al. | |
| 4,989,619 | A | 2/1991 | Clearman et al. | |
| 5,065,776 | A | 11/1991 | Lawson et al. | |
| 5,067,499 | A * | 11/1991 | Banerjee | A24D 1/22 131/194 |
| 5,082,008 | A | 1/1992 | Johnson | |
| 5,247,947 | A | 9/1993 | Clearman et al. | |
| 5,327,915 | A | 7/1994 | Porenski et al. | |
| 7,479,098 | B2 | 1/2009 | Thomas et al. | |
| 7,793,665 | B2 | 9/2010 | Dube et al. | |
| 8,186,359 | B2 | 5/2012 | Ademe et al. | |
| 8,739,802 | B2 | 6/2014 | Fagg | |
| 9,877,506 | B2 | 1/2018 | Akiyama et al. | |
| 2003/0159703 | A1 | 8/2003 | Yang et al. | |
| 2004/0261807 | A1 | 12/2004 | Dube et al. | |
| 2008/0029106 | A1* | 2/2008 | Mishra | A24D 1/002 131/365 |
| 2008/0245377 | A1* | 10/2008 | Marshall | A24B 15/10 131/332 |
| 2009/0007925 | A1 | 1/2009 | Rasouli et al. | |
| 2009/0065011 | A1 | 3/2009 | Maeder et al. | |
| 2011/0036367 | A1* | 2/2011 | Saito | A24D 1/22 131/332 |
| 2011/0041861 | A1 | 2/2011 | Sebastian et al. | |
| 2011/0083676 | A1* | 4/2011 | Karles | A24D 3/025 131/274 |
| 2013/0255702 | A1 | 10/2013 | Griffith, Jr. et al. | |
| 2014/0123991 | A1 | 5/2014 | Fujita et al. | |
| 2014/0326260 | A1 | 11/2014 | Gladden et al. | |
| 2015/0013703 | A1 | 1/2015 | Akiyama et al. | |
| 2015/0083150 | A1 | 3/2015 | Conner et al. | |
| 2017/0055578 | A1 | 3/2017 | Oda et al. | |

FOREIGN PATENT DOCUMENTS

| | | | |
|---|---|---|---|
| CN | 1059265 | A | 3/1992 |
| CN | 1059841 | A | 4/1992 |
| CN | 101778578 | A | 7/2010 |
| CN | 102481021 | A | 5/2012 |
| CN | 104160007 | A | 11/2014 |
| CN | 102481021 | B | 12/2014 |
| CN | 104203017 | A | 12/2014 |
| CN | 105705048 | A | 6/2016 |
| EP | 0271036 | A2 | 6/1988 |
| EP | 0277519 | A2 | 8/1988 |
| EP | 0 352 109 | A2 | 1/1990 |
| EP | 0 472 367 | A1 | 2/1992 |
| JP | 63-164875 | A | 7/1988 |
| JP | 63-192372 | A | 8/1988 |
| JP | 2010-535530 | A | 11/2010 |
| JP | 2013-502232 | A | 1/2013 |
| TW | 201402027 | A | 1/2014 |
| TW | 201545673 | A | 12/2015 |
| TW | 201616988 | A | 5/2016 |
| WO | WO 2009/022232 | A2 | 2/2009 |
| WO | WO 2010/113702 | A1 | 10/2010 |
| WO | WO 2013/146951 | A2 | 10/2013 |
| WO | WO 2013/183761 | A1 | 12/2013 |
| WO | WO 2014/140168 | A2 | 9/2014 |
| WO | WO 2015/165709 | A1 | 11/2015 |
| WO | WO 2015/174442 | A1 | 11/2015 |

OTHER PUBLICATIONS

Written Opinion of the International Searching Authority for PCT/JP2017/023782 (PCT/ISA/237) dated Aug. 8, 2017.

Taiwanese Office Action and Search Report for Taiwanese Application No. 106121982, dated Jun. 28, 2019, with English translation.

Taiwanese Office Action and Search Report for Taiwanese Application No. 106121981, dated Jun. 25, 2019, with a partial English translation.

Extended European Search Report, dated Dec. 17, 2019, for European Application No. 17820225.5.

International Search Report and Written Opinion of the International Searching Authority (forms PCT/ISA/210 and PCT/ISA/237), dated Aug. 8, 2017, for International Application No. PCT/JP2017/023778 with an English translation of the International Search Report.

International Search Report and Written Opinion of the International Searching Authority (forms PCT/ISA/210 and PCT/ISA/237), dated Aug. 8, 2017, for International Application No. PCT/JP2017/023780 with an English translation of the International Search Report.

Taiwanese Office Action and Search Report for Taiwanese Application No. 106121981, dated Jan. 30, 2019 with English translation.

Eurasian Office Action dated Sep. 4, 2019 , for corresponding Eurasian Application No. 201990192, with English translation.

Chinese Office Action and Search Report for Chinese Application No. 201780040093.2, dated Sep. 16, 2020, with an English translation.

Chinese Office Action and Search Report for Chinese Application No. 201780040094.7, dated Sep. 16, 2020, with an English translation.

Chinese Office Action and Search Report for Chinese Application No. 201780040210.5, dated Sep. 17, 2020, with an English translation.

International Preliminary Report on Patentability and English translation of the Written Opinion of the International Searching Authority (Forms PCT/IB/373 and PCT/ISA/237) for International Application No. PCT/JP2017/023778, dated Jan. 10, 2019.

International Preliminary Report on Patentability and English translation of the Written Opinion of the International Searching Authority (Forms PCT/IB/373 and PCT/ISA/237) for International Application No. PCT/JP2017/023780, dated Jan. 10, 2019.

International Preliminary Report on Patentability and English translation of the Written Opinion of the International Searching Authority (Forms PCT/IB/373 and PCT/ISA/237) for International Application No. PCT/JP2017/023782, dated Jan. 10, 2019.

Extended European Search Report, dated Feb. 12, 2020, for European Application No. 17820224.8.

Extended European Search Report, dated Feb. 13, 2020, for European Application No. 17820226.3.

European Communication pursuant to Article 94(3) EPC for European Application No. 17 820 224.8, dated Nov. 6, 2020.

U.S. Office Action for U.S. Appl. No. 16/232,511, dated Apr. 14, 2021.

U.S. Office Acticn for U.S. Appl. No. 16/232,511, dated Jan. 7, 2022.

U.S. Office Action for U.S. Appl. No. 16/232,527, dated Dec. 29, 2021.

U.S. Office Action for U.S. Appl. No. 16/232,511, dated Apr. 18, 2022.

U.S. Office Action for U.S. Appl. No. 16/232,527, dated Mar. 17, 2023.

(56) References Cited

OTHER PUBLICATIONS

U.S. Office Action for U.S. Appl. No. 16/232,527, dated Sep. 18, 2023.

* cited by examiner

FLAVOR INHALER

CROSS-REFERENCE TO RELATED APPLICATIONS

This application is a Continuation Application of PCT Application No. PCT/JP2017/023782 filed Jun. 28, 2017 and based upon and claiming the benefit of priority from Japanese Patent Applications No. 2016-131585 filed Jul. 1, 2016, No. 2016-131586 filed Jul. 1, 2016, and No. 2016-131587 filed Jul. 1, 2016, the entire contents of which are incorporated herein by reference.

BACKGROUND OF THE INVENTION

1. Field of the Invention

The present invention relates to a flavor inhaler capable of inhaling a flavor from a mouthpiece end.

2. Description of the Related Art

Jpn. PCT National Publication No. 2010-535530 discloses a distillation-based smoking article, that is, a smoking article including a combustible heat source, an aerosol generating substrate located downstream of the combustible heat source, and a heat conductive element located around a rear portion of the combustible heat source and a front portion of the aerosol generating substrate. In such a smoking article, heat from the combustible heat source is transferred to the aerosol generating substrate via the heat conductive element and aerosol is generated. The publication discloses that one or more flavors are added to a rear end surface of the combustible heat source.

BRIEF SUMMARY OF THE INVENTION

The inventors found that in a heating type smoking article as described in Jpn. PCT National Publication No. 2010-535530, when a flavorant is carried on a combustible heat source to enhance the flavor, a problem occurs, such as a chemical change of the flavorant during storage or expression of an undesirable flavor due to heat during use, depending on a type of the flavorant.

In view of the above, the present invention has an object to provide a flavor inhaler that includes a combustible heat source carrying a flavorant in addition to a flavor source held in a main body and that is capable of expressing an enhanced flavor favorable to a user. More specifically, the present invention has an object to provide a flavor inhaler that hardly causes a chemical change of a flavorant during storage and does not express an undesirable flavor during use.

A flavor inhaler according to an embodiment of the present invention comprises:

a tubular holder that extends from a mouthpiece end to a distal end;

a combustion type heat source that is provided at the distal end, contains activated carbon, and carries a first flavorant; and a flavor source that is held in the holder and carries a second flavorant, wherein the first flavorant contains at least one selected from the group consisting of anethole, 2-pinene, β-citronellol, linalyl acetate, limonene, anisaldehyde, 4-terpineol, 2-β-pinene, jasmone, sabinene, linalool, 1,8-cineole, phenethyl alcohol, and myristicin, and the second flavorant contains at least one selected from the group consisting of α-terpinene, γ-terpinene, nerol, geraniol, and decanal.

A flavor inhaler according to another embodiment of the present invention comprises:

a tubular holder that extends from a mouthpiece end to a distal end;

a combustion type heat source that is provided at the distal end, contains activated carbon, and carries a first flavorant;

a flavor source that is held in the holder; and a filter portion that is provided on a side of the mouthpiece end in the holder and includes a flavorant capsule containing a third flavorant, wherein the first flavorant contains at least one selected from the group consisting of anethole, 2-pinene, β-citronellol, linalyl acetate, limonene, anisaldehyde, 4-terpineol, 2-β-pinene, jasmone, sabinene, linalool, 1,8-cineole, phenethyl alcohol, and myristicin, and the third flavorant contains at least one selected from the group consisting of menthol, α-terpinene, γ-terpinene, nerol, geraniol, and decanal.

According to the present invention, a flavor inhaler capable of expressing an enhanced flavor favorable to a user can be provided.

DETAILED DESCRIPTION OF THE INVENTION

Hereinafter, an embodiment of a flavor inhaler will be described with reference to the drawings. The following description is intended to detail the invention, and is not intended to limit the invention.

Figure 1:
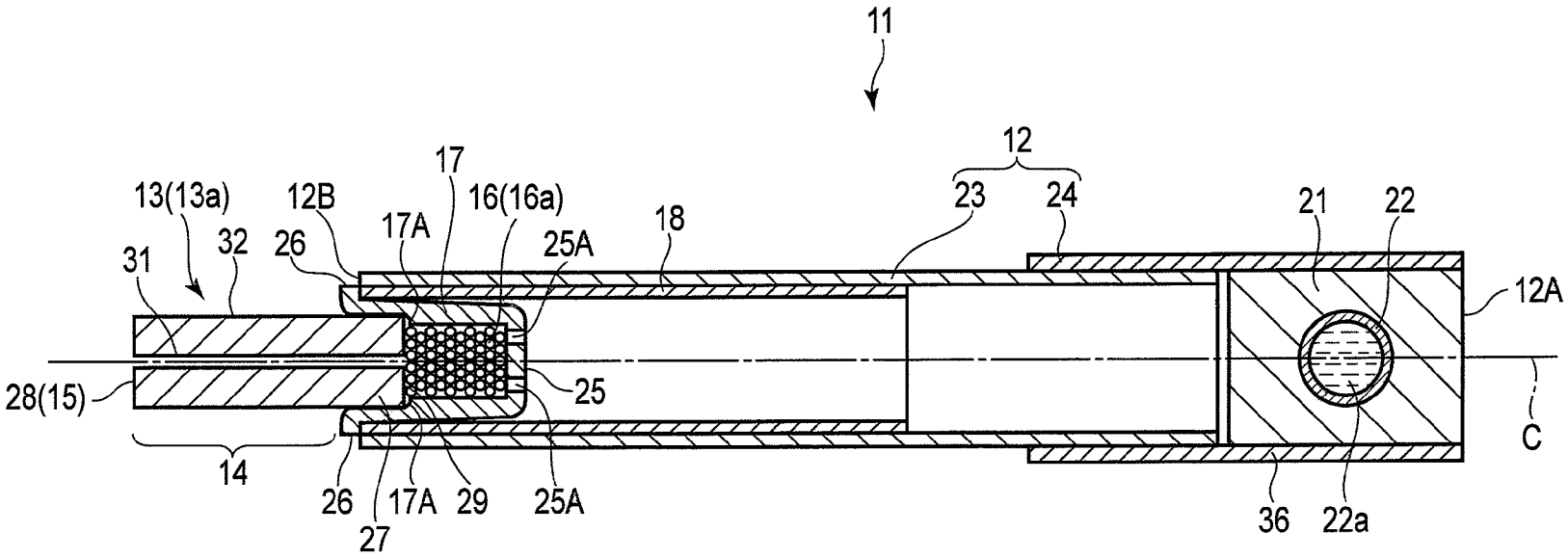
FIG. 1 is a cross-sectional view showing a flavor inhaler according to an embodiment cut along a plane including a center axis C.

As shown in FIG. 1, a flavor inhaler 11 according to the embodiment includes a tubular (cylindrical) holder 12 extending from a mouthpiece end 12A to a distal end 12B, a combustion type heat source 13 provided at the distal end 12B of the holder 12 and containing activated carbon, a first flavorant 13*a* carried on the combustion type heat source 13, a flavor source 16 provided in the holder 12, a second flavorant 16*a* carried on the flavor source 16, a cup 17 for accommodating the flavor source 16 therein, an aluminum laminate paper 18 interposed between the holder 12 and the cup 17 inside the holder 12, a filter portion 21 provided on the side of the mouthpiece end 12A inside the holder 12, and a capsule 22 (flavorant capsule) embedded inside the filter portion 21 and containing a third flavorant 22*a*.

If the flavor inhaler 11 includes the first flavorant 13*a* carried on the combustion type heat source 13 and the second flavorant 16*a* carried on the flavor source 16, the flavor inhaler 11 may not include the capsule 22 containing the third flavorant 22*a*. Alternatively, if the flavor inhaler 11 includes the first flavorant 13*a* carried on the combustion type heat source 13 and the capsule 22 containing the third flavorant 22*a*, the flavor inhaler 11 may not include the second flavorant 16*a* carried on the flavor source 16.

The first flavorant 13*a* contains at least one selected from the group consisting of anethole, 2-pinene, β-citronellol, linalyl acetate, limonene, anisaldehyde, 4-terpineol, 2-β-pinene, jasmone, sabinene, linalool, 1,8-cineole, phenethyl alcohol, and myristicin. The first flavorant 13*a* may be a single flavor compound or a mixture of flavor compounds. If the flavor compound described above is used as the first flavorant 13*a*, the flavor compound is stably maintained during storage of the flavor inhaler 11, and when using the flavor inhaler 11, an undesirable flavor is not provided to the user.

Preferably, the first flavorant 13*a* is substantially free of any of menthol, α-terpinene, γ-terpinene, nerol, geraniol, and decanal. If menthol is used as the first flavorant 13*a*, there is a tendency to provide a metal-like undesirable flavor to the user when using the flavor inhaler 11. In addition, if α-terpinene, γ-terpinene, nerol, geraniol, or decanal is used as the first flavorant 13*a*, the flavors carried on the combustion type heat source 13 tend to be lost during storage of the flavor inhaler 11.

In the present specification, the phrase "substantially free of a flavorant" means that a process of causing the flavorant to be carried on a corresponding carry portion is not performed, but the portion may contain a trace of the flavorant transferred from another carry portion.

If the flavor inhaler 11 includes the first flavorant 13*a* carried on the combustion type heat source 13 and the second flavorant 16*a* carried on the flavor source 16 and does not include the capsule 22 containing the third flavorant 22*a*, the second flavorant 16*a* contains at least one selected from the group consisting of α-terpinene, γ-terpinene, nerol, geraniol, and decanal. Alternatively, if the flavor inhaler 11 includes the second flavorant 16*a* carried on the flavor source 16 together with the first flavorant 13*a* carried on the combustion type heat source 13 and the capsule 22 containing the third flavorant 22*a*, the second flavorant 16*a* may be any type of flavorant, and preferably contains at least one selected from the group consisting of α-terpinene, γ-terpinene, nerol, geraniol, and decanal.

The second flavorant 16*a* may be a single flavor compound or a mixture of flavor compounds. The second flavorant 16*a* is different from the first flavorant 13*a*. If the flavor compound described above is used as the second flavorant 16*a*, the flavor compound is stably maintained during storage of the flavor inhaler 11, and when using the flavor inhaler 11, an undesirable flavor is not provided to the user. The second flavorant 16*a* preferably contains at least one selected from the group consisting of nerol and geraniol. Nerol and geraniol are less likely to transfer from the flavor source 16 to the combustion type heat source 13 because of their low vapor pressure.

Preferably, the second flavorant 16*a* is substantially free of any of anethole, 2-pinene, β-citronellol, linalyl acetate, limonene, anisaldehyde, 4-terpineol, 2-β-pinene, jasmone, sabinene, linalool, 1,8-cineole, phenethyl alcohol, and myristicin. As described above, these flavor compounds can be carried on the combustion type heat source 13 as the first flavorant 13*a*. The combustion type heat source 13 contains activated carbon, and thus has a high power for holding a flavorant. In addition, the combustion type heat source 13 is located at the distal end 12B of the holder 12, and thus the carried first flavorant 13*a* can be sensed as external flavor. Therefore, it is preferable that the first flavorant 13*a* contains these flavor compounds, and the second flavorant 16*a* is preferably substantially free of these flavor compounds.

More preferably, the second flavorant 16*a* is substantially free of menthol. A flavorant having high volatility is not suitable as the second flavorant 16*a*. If a flavorant having high volatility such as menthol is used as the second flavorant 16*a*, such a flavor is liable to be lost during storage of the flavor inhaler 11. Also, if menthol is used as the second flavorant 16*a*, menthol may transfer to the combustion type heat source 13 and a metal-like undesirable flavor may be provided to the user when using the flavor inhaler 11.

If the flavor inhaler 11 includes the capsule 22 containing the third flavorant 22*a* together with the first flavorant 13*a* and the second flavorant 16*a*, the third flavorant 22*a* may be any type of flavorant, and preferably contains at least one selected from the group consisting of menthol, α-terpinene, γ-terpinene, nerol, geraniol, and decanal. Alternatively, if the flavor inhaler 11 includes the first flavorant 13*a* and the capsule 22 containing the third flavorant 22*a* and does not include the second flavorant 16*a*, the third flavorant 22*a* contains at least one selected from the group consisting of menthol, α-terpinene, γ-terpinene, nerol, geraniol, and decanal.

The third flavorant 22*a* may be a single flavor compound or a mixture of flavor compounds. The flavor compound contained in the third flavorant 22*a* may be the same as any of the flavor compounds contained in the first flavorant 13*a* and the second flavorant 16*a*, or may be different from any of the flavor compounds contained in the first flavorant 13*a* and the second flavorant 16*a*. In the former case, the third flavorant 22*a* can supplement the flavor compounds contained in the first flavorant 13*a* and the second flavorant 16*a*. In the latter case, the third flavorant 22*a* can change the flavor of the flavor inhaler after crushing the capsule 22.

Since the third flavorant 22*a* is contained in the capsule 22, it hardly volatilizes during storage and is stably maintained. Therefore, the third flavorant 22*a* can be any of the flavorants that are described above as being not preferable as the first flavorant 13*a*.

More preferably, the third flavorant 22*a* contains menthol. Alternatively, more preferably, the third flavorant 22*a* contains at least one selected from the group consisting of α-terpinene, γ-terpinene, nerol, geraniol, and decanal, and is different from the second flavorant 16*a*. Furthermore preferably, the third flavorant 22*a* contains at least one selected from the group consisting of α-terpinene and γ-terpinene, and is different from the second flavorant 16*a*. Since α-terpinene and γ-terpinene have high vapor pressure, they are preferably encapsulated in the capsule 22.

The first flavorant 13*a* is carried on the combustion type heat source 13 in an amount of, for example, 0.5 to 40 mg, the second flavorant 16*a* is carried on the flavor source 16 in an amount of, for example, 0.5 to 40 mg, and the third flavorant 22*a* is contained in the capsule 22 in an amount of, for example, 2 to 80 mg.

In the present specification, the expression "the second flavorant is different from the first flavorant" and the expression "the third flavorant is different from the second flavorant" mean that a flavorant containing at least one flavor compound is not completely identical to another flavorant containing at least one flavor compound. For example, the second flavorant consisting of flavor compounds A and C is different from the first flavorant consisting of flavor compounds A and B.

As described above, in the present invention, in addition to the flavor source 16, the combustion type heat source 13 is used as a flavorant carry portion. The combustion type heat source 13 contains activated carbon and thus is advantageous in that power for holding the first flavorant 13*a* is high. Furthermore, the combustion type heat source 13 is positioned at the distal end 12B of the holder 12, and when the flavor inhaler 11 is held between the user's lips, it is located at a position close to the user's nose. Therefore, the combustion type heat source 13 has an advantage of delivering flavor (external flavor) to the user's nose even with a small amount of the first flavorant 13*a*. Therefore, according to the present invention, it is possible to provide a flavor inhaler which expresses an enhanced flavor favorable to the user by incorporating a flavorant at the optimum addition position of the flavor inhaler according to the properties of the flavorant.

In the flavor inhaler 11, the flavor source 16 carrying the second flavorant 16*a* is heated by the combustion type heat source 13 carrying the first flavorant 13*a*, so that the user can taste the flavor derived from the first flavorant 13*a*, the second flavorant 16*a*, and the flavor source 16 by inhaling from the mouthpiece side. In addition, the flavor inhaler 11 can release the third flavorant 22*a* contained in the capsule 22 when the user crushes the capsule 22 with fingers, thereby enhancing the flavor or changing the flavor. Furthermore, when the flavor inhaler 11 is taken out of the package, the user can sense the flavor (external flavor) diffused from the first flavorant 13*a*. The user can also sense the flavor (external flavor) diffused from the first flavorant 13*a* before and after igniting the combustion type heat source 13 while holding the flavor inhaler 11 with the lips.

Each element of the flavor inhaler 11 will be described below.

The holder 12 includes a first portion 23 that holds the combustion type heat source 13 and the cup 17, and a second portion 24 that connects the first portion 23 and the filter portion 21 located on the mouthpiece end 12A side. The first portion 23 is a paper tube formed by winding paper in a cylindrical shape. The second portion 24 is paper used for tipping paper generally used as paper wrapped around a filter portion of a filter-tipped cigarette (paper-wrapped tobacco), and is formed by cylindrically winding the paper used for the tipping paper. The aluminum laminate paper 18 is formed by laminating aluminum on a paper, and as compared with ordinary paper, the heat resistance and the thermal conductivity are improved. The aluminum laminate paper 18 prevents the first portion 23 (paper pipe) of the holder 12 from burning even when the combustion type heat source 13 is ignited. The central axis C of the holder 12 coincides with the central axis C of the combustion type heat source 13.

The flavor source 16 is provided downstream of the combustion type heat source 13 at a position adjacent to the combustion type heat source 13. The flavor source 16 consists of granules formed from tobacco extracts and the like. Furthermore, the flavor source 16 is not limited to granules, and tobacco leaves themselves can be used. That is, as the flavor source 16, it is possible to adopt tobacco materials such as general cut tobacco used for cigarettes, granular tobacco used for snuff, roll tobacco, and molded tobacco. The flavor source 16 in which a flavor is carried on a carrier made of a porous material or a non-porous material may be adopted. The roll tobacco is obtained by forming sheet-like regenerated tobacco into a roll shape, and has a flow path inside. The molded tobacco is obtained by molding granular tobacco. The above-mentioned second flavorant 16*a* is carried on the tobacco materials or the carriers used as the flavor source 16. The second flavorant 16*a* can be carried on the flavor source 16 by spraying or applying a second flavorant 16*a*-containing liquid to the flavor source 16 or by immersing the flavor source 16 in the second flavorant 16*a*-containing liquid. The flavor source 16 generally has an acidic pH, for example a pH of 4 to 7.

For analyzing the pH of the flavor source 16, for example, the following method can be adopted. First, 400 mg of the flavor source 16 is collected, 4 mL of pure water is added, and shaking extraction is carried out for 60 minutes. In a laboratory controlled at room temperature of 22° C., the extract is left in a sealed container until room temperature to harmonize the temperature. After harmonization, the lid is opened, and a glass electrode of a pH meter (SevenEasy S20 manufactured by METTLER TOLEDO) is soaked in a collection liquid to start the measurement. The pH meter is calibrated in advance using pH meter calibration liquids with pH 4.01, 6.87, and 9.21. A point at which output variations from a sensor become stable within 0.1 mV for 5 seconds is used as the pH of the extracted solution (flavor source 16). The pH measuring method of the flavor source 16 is an example, and other methods may be of course adopted.

The cup 17 is formed of a metallic material to have a bottomed cylindrical shape. The cup 17 includes a bottom portion 25 provided with a plurality of openings 25A. When the user performs inhalation, the tobacco flavor is inhaled to the downstream side of the holder 12 through the openings 25A together with the air. The cup 17 includes an edge portion 26 that is bent toward the radial outer side of the holder 12, and can be caught by the distal end of the holder 12 and the aluminum laminate paper 18. The inner peripheral surface of the cup 17 is provided with a step portion 17A that is in contact with the proximal end surface 29 of the combustion type heat source 13. The inner peripheral surface of the cup 17 can receive a main body portion 27 of the combustion type heat source 13 together with the step portion 17A to hold the combustion type heat source 13 to prevent it from falling off.

The cup 17 may be a cup made of paper. A cup made of paper has, for example, the same structure as that of the metal cup described above. A cup made of paper can be manufactured using known techniques of pulp injection molding. Specifically, a cup made of paper can be manufactured by kneading a raw material containing pulp, binder, and water, and injecting it into a heated mold, followed by drying and solidification. As the binder, it is preferable to use CMC (carboxymethyl cellulose) or CMC-Na (sodium carboxymethyl cellulose) from the viewpoint of flavor. A cup made of paper has the property that the heat conduction speed to the flavor source 16 is slower as compared to that of a metal cup. In addition, a cup made of paper can reduce the weight of the flavor inhaler and the manufacturing cost.

The filter portion 21 is composed of a filter generally used for cigarettes. Similarly, the capsule 22 is a flavorant capsule generally used for cigarettes, and stores a liquid containing the third flavorant 22*a*. The third flavorant 22*a*, for example, contains at least one selected from the group consisting of menthol, α-terpinene, γ-terpinene, nerol, geraniol, and decanal. As described above, menthol may generate undesirable smoking flavor when carried on the combustion type heat source 13, or when carried on the flavor source 16, menthol may volatilize and transfer to the combustion type heat source 13 to generate undesirable smoking flavor. Therefore, it is desirable that menthol is encapsulated in the capsule 22. As a solvent for the third flavorant 22*a*, a solvent capable of dissolving the flavorant, for example medium-chain triglyceride (MCT), can be used.

The filter portion 21 can be formed of various types of fillers. In the present embodiment, the filter portion 21 is composed of a filler of cellulose-based semisynthetic fiber such as cellulose acetate, for example, but the filler is not limited thereto. Examples of the filler that can be used include plant fibers such as cotton, hemp, manila hemp, palm, and rush, animal fibers such as wool and cashmere, cellulose-based regenerated fibers such as rayon, synthetic fibers such as nylon, polyester, acrylic, polyethylene, and polypropylene, or a combination thereof. Besides the above-mentioned filler of the cellulose acetate fiber, the constituent element of the filter portion 21 may be a charcoal filter containing charcoal or a filter containing particulates other than charcoal. Furthermore, the filter portion 21 may have a multi-segment structure in which two or more different types of segments are connected in the axial direction.

By crushing the capsule 22 included in the filter portion 21, it is possible to enhance or change the smoking flavor of mainstream smoke. As a result, it is possible to provide a more attractive product conforming to the user's preference. Furthermore, it is possible to maintain in the flavorant capsule a flavorant that may be decomposed or volatilized by heat when carried on the combustion type heat source 13 or a flavorant that may volatilize when carried on the flavor source 16. Accordingly, depending on the properties of the flavorant, the flavorant can be carried on the combustion type heat source 13, can be carried on the flavor source 16, or can be encapsulated in the capsule 22. Therefore, it is possible to further increase the degree of freedom in designing flavorant of the product (increase the options of flavorant).

Figure 2:
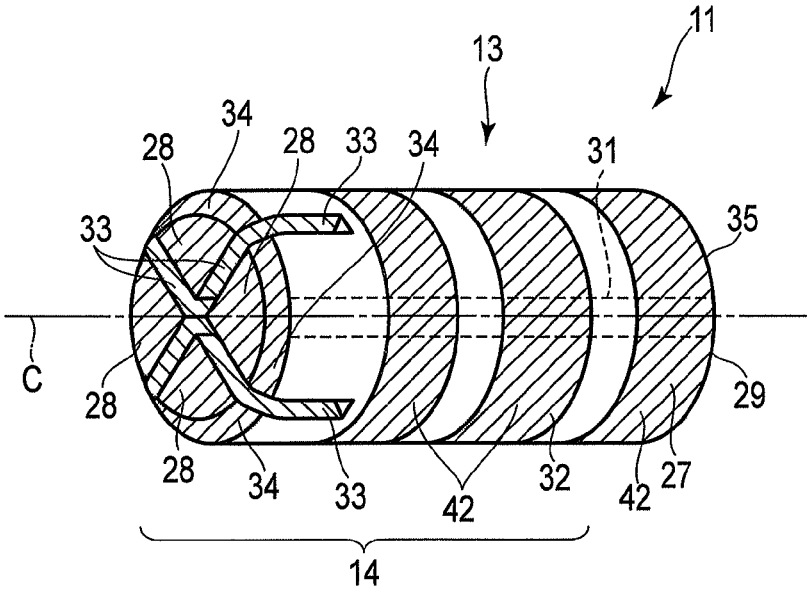
FIG. 2 is a perspective view showing a combustion type heat source of the flavor inhaler shown in FIG. 1.

As shown in FIG. 2, the combustion type heat source 13 (carbon heat source) can be formed by integrally molding a combustion material that is a mixture containing activated carbon derived from plants, nonflammable additives (for example, calcium carbonate), a binder (organic binder or inorganic binder, for example, carboxymethyl cellulose), water, etc., by a method of tableting, press casting, or the like. The combustion type heat source 13 is a briquettes-like mixture containing activated carbon, a binder, etc. The combustion type heat source 13 includes so-called highly activated carbon among activated carbon. Highly activated carbon indicates activated carbon having a specific surface area of, for example, 1300 $m^2/g$ or more, measured by the Brunauer, Emmet and Teller method (BET method) standardized by ISO9277: 2010 as well as JISZ8830: 2013. The activated carbon used for the combustion type heat source 13 has a porous structure including a plurality of macropores and a plurality of micropores.

The BET specific surface area of the activated carbon included in the combustion type heat source 13 is, for example, 1300 $m^2/g$ or more. More preferably, the BET specific surface area of the activated carbon included in the combustion type heat source 13 is, for example, 2000 $m^2/g$ or more and 2500 $m^2/g$ or less. Most preferably, the BET specific surface area of the activated carbon included in the combustion type heat source 13 is, for example, 2050 $m^2/g$ or more and 2300 $m^2/g$ or less. Therefore, the activated carbon used in the combustion type heat source 13 is classified as highly activated carbon, and has larger amounts of macropores and micropores than those of ordinary activated carbon. In other words, the activated carbon used in the combustion type heat source 13 has a higher degree of activation than that of ordinary activated carbon. That is, the activated carbon used in the combustion type heat source 13 is obtained by applying heat treatment or the like to a carbon material to remove volatile impurities and increase the activation degree higher than that of ordinary activated carbon.

The BET specific surface area of the activated carbon included in the combustion type heat source 13 is substantially the same as the BET specific surface area of the raw activated carbon used for manufacturing the combustion type heat source 13. Unlike the flavor source 16, the combustion type heat source 13 generally has a basic pH, for example a pH of 8 to 11.

The combustion type heat source 13 can secure a large amount of sites capable of adsorbing the first flavorant 13*a* and stably retaining the first flavorant 13*a* for a long period of time, due to the porous structure containing a large number of macropores and micropores of highly activated carbon. Thereby, it is possible to realize the combustion type heat source 13 having a high residual rate of the first flavorant 13*a* even after storage, and also to realize the flavor inhaler 11 including the same. Therefore, it is possible to provide an attractive product that matches the user's preference. Moreover, according to the above structure, ignition properties can be improved by the porous structure of highly activated carbon, and the flavor inhaler 11 that can be easily ignited can be realized. In addition, with the porous structure of highly activated carbon, combustion properties of the combustion type heat source 13 can be improved, and stable combustion can be continued in the combustion type heat source 13.

The combustion type heat source 13 may contain activated carbon in the range of 10 wt % to 99 wt %. Here, from the viewpoint of supply of a sufficient amount of heat and combustion properties such as preventing ash from falling, it is preferable that the activated carbon contained in the combustion type heat source 13 has a concentration of, for example, 30 wt % or more and 60 wt % or less. More preferably, the activated carbon contained in the combustion type heat source 13 has a concentration of 30 wt % or more and 45 wt % or less.

If the amount of carbon contained in the combustion type heat source 13 is too large, an amount of generated heat tends to become too large, whereas if the amount of carbon contained in the combustion type heat source 13 is too small, there is a tendency that a sufficient amount of heat cannot be obtained. If, as in the above structure, the activated carbon contained in the combustion type heat source 13 has a concentration of 30 wt % or more, it is possible to supply a sufficient amount of heat to the flavor source 16. This allows the flavor source 16 to be heated at an appropriate temperature, and the components can be efficiently extracted from the flavor source 16 to be delivered to the user's mouth. Furthermore, if the activated carbon contained in the combustion type heat source 13 has a concentration of 60 wt % or less, it is possible to reduce ash scattering accompanying the combustion, and to decrease the amount of carbon monoxide contained in the mainstream smoke.

As the organic binder, it is possible to use, for example, a mixture containing at least one of CMC (carboxymethyl cellulose), CMC-Na (sodium carboxymethyl cellulose), alginates, ethylene vinyl acetate (EVA), polyvinyl alcohol (PVA), polyvinyl acetate (PVAc), and saccharides.

As the inorganic binder, it is possible to use, for example, a mineral-based binder such as purified bentonite, or a silica-based binder such as colloidal silica, water glass, and calcium silicate.

For example, from the viewpoint of flavor, the above-mentioned binder preferably contains 1 wt % to 10 wt % of CMC or CMC-Na, more preferably 1 wt % to 8 wt % of CMC or CMC-Na.

As the nonflammable additives, it is possible to use, for example, oxides or carbonates composed of sodium, potassium, calcium, magnesium, silicon, or the like. The combustion type heat source 13 can contain 40 wt % to 89 wt % of the nonflammable additive.

Here, it is preferable that calcium carbonate is used as the nonflammable additive, and that the combustion type heat source 13 contains 40 wt % to 60 wt % of the nonflammable additive.

For the purpose of improving combustion properties, the combustion type heat source 13 may contain alkali metal salt such as sodium chloride at a ratio of 1 wt % or less.

As shown in FIG. 1 and FIG. 2, the combustion type heat source 13 is formed to have a cylindrical shape. The combustion type heat source 13 includes: a main body portion 27 held in the holder 12; a protruding portion 14 (exposed portion) protruding from the distal end 12B of the holder 12; a distal end surface 28 provided in the protruding portion 14; a proximal end surface 29 facing the distal end surface 28; a ventilation path 31 for supplying air into the holder 12; an outer peripheral surface 32 adjacent to the distal end surface 28; and grooves 33 provided in the protruding portion 14. The ventilation path 31 is provided along the center axis C of the combustion type heat source 13, and is provided so as to penetrate the combustion type heat source 13. The ventilation path 31 communicates with the distal end surface 28 and the proximal end surface 29. The ventilation path 31 is provided so as to extend over both the main body portion 27 and the protruding portion 14. The portion on the distal end surface 28 side of the ventilation path 31 is integral with the grooves 33. The outer peripheral surface 32 is formed around the combustion type heat source 13 at a position corresponding to the protruding portion 14. The protruding portion 14 (exposed portion) also protrudes from the distal end of the cup 17.

The combustion type heat source 13 includes a first chamfered portion 34 formed between the distal end surface 28 and the outer peripheral surface 32, and a second chamfered portion 35 formed between the proximal end surface 29 and the outer peripheral surface 32. With the first chamfered portion 34 and the second chamfered portion 35, cracking or chipping in the corner portion of the combustion type heat source 13 is less likely to occur.

The grooves 33 are formed to have an overall cross shape as viewed from the distal end surface 28 side. The shape of the grooves 33 is not limited to a cross shape. The number of grooves 33 is discretionary. In addition, the shape formed by the entire grooves 33 can be discretionary. For example, a plurality of grooves 33 may extend radially toward the outer peripheral surface 32 about the ventilation path 31. In this case, the angle formed by the adjacent grooves 33 can be appropriately set within a range of, for example, 5° or more and 95° or less. Furthermore, in the present embodiment, the grooves 33 are formed to be recessed from the distal end surface 28 and the outer peripheral surface 32 so as to extend over them. The grooves 33 are provided so as to communicate with the ventilation path 31. The depth (length) of the grooves 33 with respect to the center axis C direction of the combustion type heat source 13 is, for example, preferably ⅓ to ⅕ of the total length with respect to the central axis C direction.

The combustion type heat source 13 is preferably formed to have the following dimensions. The total length of the combustion type heat source 13 (the length of the combustion type heat source 13 with respect to the central axis C direction) is appropriately set within a range of, for example, 5 mm or more and 30 mm or less, more preferably 10 mm or more and 20 mm or less. Among them, the length of the protruding portion 14 with respect to the central axis C direction is appropriately set within a range of, for example, 5 mm or more and 15 mm or less, more preferably 5 mm or more and 10 mm or less. Therefore, the length of the protruding portion 14 is set within a range of, for example, ⅔ or more and ⅘ or less of the total length of the combustion type heat source 13. The length of the portion of the combustion type heat source 13 inserted into the cup 17 (the length with respect to the center axis C direction of the main body portion 27, the insertion length) is appropriately set within a range of 2 mm or more and 10 mm or less, more preferably 2 mm or more and 5 mm or less.

The diameter of the combustion type heat source 13 (the length of the combustion type heat source 13 with respect to the direction intersecting with the center axis C) is appropriately set within a range of, for example, 3 mm or more and 15 mm or less. The depth (length) of the grooves 33 with respect to the center axis C direction is appropriately set within a range of, for example, 1 mm or more and 5 mm or less, more preferably 2 mm or more and 4 mm or less. The width (inner diameter) W of the grooves 33 is appropriately set within a range of, for example, 0.5 mm or more and 1 mm or less.

The grooves 33 may be provided to be recessed from at least one of the distal end surface 28 and the outer peripheral surface 32. For example, the grooves 33 may be provided so as to be recessed from the distal end surface 28 to communicate with the ventilation path 31, and may be provided so as not to be opened toward the outer peripheral surface 32 side. Likewise, for example, the grooves 33 may be provided so as to be recessed from the outer peripheral surface 32 to communicate with the ventilation path 31, and may be provided so as not to be opened toward the distal end surface 28 side. In the latter case, it is preferable that the ventilation path 31 extends to the distal end surface 28 and is opened to the outside on the distal end surface 28.

The combustion type heat source 13 may not have the ventilation path 31. In this case, it is preferable that the holder 12 (the first portion 23) is provided with a plurality of small holes for ventilation. When the user performs inhalation, air is supplied through the small holes to the holder 12 and the flavor source 16 in the holder 12.

In the present embodiment, the first flavorant 13*a* is carried on the combustion type heat source 13.

The combustion type heat source 13 has a protrusion 14 protruding from the distal end 12B of the holder 12, and the first flavorant 13*a* is preferably carried on the protrusion 14. According to this configuration, the first flavorant 13*a* carried on the protrusion 14 can be contributed not only as an internal flavor to be incorporated in mainstream smoke, but also as an external flavor delivered directly to the user's nose without being taken into the mainstream smoke. In particular, when the flavor inhaler 11 is held between the lips, the protrusion 14 of the combustion type heat source 13 is located at a position close to the user's nose; therefore, flavor (external flavor) can be efficiently delivered to the user's nose even with a small amount of the first flavorant 13*a*.

More specifically, the first flavorant 13*a* is carried on at least one of the distal end surface 28 of the combustion type heat source 13, the first chamfered portion 34, the inner peripheral surface of the grooves 33, the outer peripheral surface 32, and the ventilation path 31 (the inner peripheral surface of the ventilation path 31). It is preferable that the first flavorant 13*a* is not carried to a substantive extent on the proximal end surface 29 and the second chamfered portion 35 of the combustion type heat source 13. However, there is a possibility that the first flavorant 13*a* volatilized or diffused from the distal end surface 28 and the first chamfered portion 34 may be adsorbed and held by the proximal end surface 29 and the second chamfered portion 35.

In one embodiment, the first flavorant 13*a* is carried on the distal end surface 28, for example. According to this configuration, the first flavorant 13*a* can be carried on the distal end surface 28, which is less likely to be held by the user. Therefore, even when the user holds the outer peripheral surface 32 of the combustion type heat source 13 before inhaling with the flavor inhaler 11, a problem that the first flavorant 13*a* is transferred to the user's fingers or the like can be prevented.

If the first flavorant 13*a* is carried on the first chamfered portion 34 and the inner peripheral surface of the grooves 33 in addition to the distal end surface 28, the amount of the first flavorant 13*a* to be carried may be changed along the center axis C. That is, in the present embodiment, the largest amount of the first flavorant 13*a* is carried on the distal end surface 28 and the first chamfered portion 34. In this case, the amount of the first flavorant 13*a* to be carried may not be uniform inside the combustion type heat source 13. The first flavorant 13*a* may be carried inside the combustion type heat source 13 so that the amount of the first flavorant 13*a* gradually decreases from the distal end surface 28 toward the proximal end surface 29.

Figure 3:
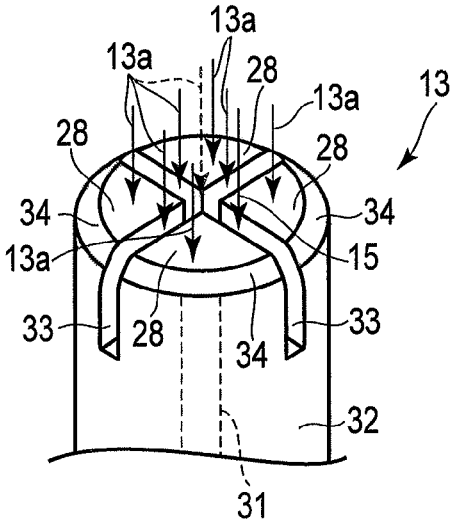
FIG. 3 is a perspective view showing a process of manufacturing the combustion type heat source of the flavor inhaler shown in FIG. 2.

Various methods can be adopted as a method of carrying the first flavorant 13*a* on the distal end surface 28 of the combustion type heat source 13. For example, as shown in FIG. 3, a nozzle is disposed to face the distal end surface 28, and droplets of the liquid containing the first flavorant 13*a* are discharged (dropped) from the nozzle toward the distal end surface 28 and the first chamfered portion 34 as indicated by the arrows in FIG. 3, causing the liquid containing the first flavorant 13*a* to adhere to the distal end surface 28 and the first chamfered portion 34. The liquid containing the first flavorant 13*a* may be discharged to the entire distal end surface 28, or may be partially discharged to a part of the distal end surface 28. For example, in order to prevent the first flavorant 13*a* from adhering to the portion corresponding to the ventilation path 31 (the ventilation path 31 and the wall portion defining the outer edge of the ventilation path 31), it is desirable to discharge droplets of the liquid containing the first flavorant 13*a* to a position deviated from the portion corresponding to the ventilation path 31. As this liquid permeates into the combustion type heat source 13 from the distal end surface 28, the first flavorant 13*a* is carried at the vicinity of the distal end surface 28. Alternatively, the first flavorant 13*a* can be carried on the distal end surface 28, the first chamfered portion 34, and the grooves 33, by grasping the position on the proximal end surface 29 side of the outer peripheral surface 32 of the combustion type heat source 13, and then immersing the distal end surface 28, the first chamfered portion 34, and the grooves 33 of the combustion type heat source 13 into the liquid containing the first flavorant 13*a* for a predetermined period of time. In addition, by pressing the distal end surface 28 against an elastic porous body (e.g., a sponge) containing the first flavorant 13*a*, the first flavorant 13*a* can be carried at the vicinity of the distal end surface 28 and the first chamfered portion 34. Furthermore, an ink-jet type can be used for discharging droplets of the liquid containing the first flavorant 13*a*.

In another embodiment, the first flavorant 13*a* is carried on the outer peripheral surface 32, for example. As shown in FIG. 2, the first flavorant 13*a* is carried on a plurality of annular carriers 42 formed on the outer peripheral surface 32 at a predetermined interval in the central axis C direction. The plurality of carriers 42 are formed in a belt shape having a predetermined width in the central axis C direction. The carriers 42 are not limited to a plurality of carriers having an annular shape. The carriers 42 may be formed in a single wide belt shape (annular shape). Furthermore, the shape of the carriers 42 is not limited to the annular shape; for example, a plurality of belt-like carriers 42 linearly extending parallel to the central axis C may be provided. In this case, it is preferable that the carriers 42 are disposed with a certain interval from adjacent other carriers 42. At this time, the plurality of carriers 42 are disposed with a certain interval around the central axis C.

It is preferable that the plurality of carriers 42 are provided closer to the proximal end surface 29 side (the mouthpiece end 12A side) than the distal end face 28 and the grooves 33. Furthermore, it is preferable that the plurality of carriers 42 are provided on the proximal end surface 29 side (the mouthpiece end 12A side) by 3 mm or more from the distal end surface 28. More preferably, the plurality of carriers 42 are desirably provided on the proximal end surface 29 side (the mouthpiece end 12A side) by 5 mm or more from the distal end surface 28. By the arrangement of the carriers 42, the first flavorant 13*a* can be disposed at a position which is not exposed to fire when the user ignites near the distal end surface 28. Such an arrangement is particularly effective when the first flavorant 13*a* that is likely to lose its flavor by ignition is carried on the carriers 42. The carriers 42 are not limited to a plurality of annular shapes. The carriers 42 may be formed in a single wide belt shape (annular shape).

The amount of the first flavorant 13*a* carried on the combustion type heat source 13 may be changed along the radial direction of the combustion type heat source 13. That is, in the present embodiment, the largest amount of the first flavorant 13*a* is carried on the outer peripheral surface 32. In this case, the amount of first flavorant 13*a* to be carried may not be uniform inside the combustion type heat source 13. The first flavorant 13*a* may be carried inside the combustion type heat source 13 so that the amount of the first flavorant 13*a* gradually decreases from the outer peripheral surface 32 toward the central axis C.

Various methods can be adopted as a method of carrying the first flavorant 13*a* on the outer peripheral surface 32 of the combustion type heat source 13. For example, a plurality of minimal rollers partially immersed in a liquid containing the first flavorant 13*a* are prepared, in which the rollers are placed in series with each other. Each roller rotates in a direction intersecting with a direction in which a plurality of rollers are placed in series. The combustion type heat source 13 is disposed so as to extend over, from the upper side, the plurality of rollers configured in the above-described manner, and the combustion type heat source 13 is rotated on the plurality of rollers. Thereby, the first flavorant 13*a* can be transferred (applied) so as to form a plurality of belt-shaped (annular) carriers 42 on the outer peripheral surface 32. Alternatively, the first flavorant 13*a* can be carried on the outer peripheral surface 32 by continuously applying a liquid containing the first flavorant 13*a* having a relatively high viscosity from a nozzle adjacent to the outer peripheral surface 32 to the rotated combustion type heat source 13. In addition, various methods such as an ink-jet type can be used for a method of applying the first flavorant 13*a* to the outer peripheral surface 32 to carry the first flavorant 13*a* on the outer peripheral surface 32.

Another embodiment, the first flavorant 13*a* is carried on the ventilation path 31, for example. The first flavorant 13*a* is carried on the ventilation path 31 by, for example, the following method. That is, the nozzle is disposed so as to face the ventilation path 31, and droplets of a liquid containing the first flavorant 13*a* are discharged (dropped) from the nozzle as indicated by the arrow of a dashed line in FIG. 3. In this manner, the liquid containing the first flavorant 13*a* is caused to adhere to the inner peripheral surface of the ventilation path 31, and the liquid permeates into the combustion type heat source 13, thereby carrying the first flavorant 13*a* at the vicinity of the inner peripheral surface of the ventilation path 31.

In the above description, it has been mainly described that droplets of the liquid containing the first flavorant 13*a* are discharged (applied) by individual application for each application position, but the flavorant can also be applied collectively using an ink-jet type.

The effects of the flavor inhaler 11 according to the present embodiment will be described. As described above, the user can sense the flavor (external flavor) diffused from the first flavorant 13*a* carried on the combustion type heat source 13, when the flavor inhaler 11 is taken out of the package prior to inhalation of the flavor inhaler 11. Furthermore, the user can also sense the flavor (external flavor) diffused from the first flavorant 13*a* before and after igniting the combustion type heat source 13 while holding the mouthpiece 36 of the holder 12 with the lips.

When the user ignites near the distal end surface 28 of the combustion type heat source 13 and starts inhalation, the combustion type heat source 13 generates heat to a predetermined temperature (for example, 250° C. to 900° C.), and the flavor source 16 is heated by the heat from the combustion type heat source 13. As a result, the second flavorant 16*a* contained in the flavor source 16 is diffused, and reach the user's mouth through the filter portion 21. In this manner, the user can enjoy the smoking flavor from the second flavorant 16*a*. At this time, the first flavorant 13*a* carried on the distal end surface 28 is taken inside the holder 12 together with the surrounding air through the ventilation path 31, mixed with the components released from the second flavorant 16*a* in the cup 17, and reaches the user's mouth through the filter portion 21. Therefore, the user can also sense the first flavorant 13*a* carried on the distal end surface 28 as an internal flavor contained in the mainstream smoke. Furthermore, the user can also enhance or change the smoking flavor of the mainstream smoke by crushing the capsule 22 with a finger as necessary to release the third flavorant 22*a* contained in the capsule 22. The internal flavor used herein refers to a flavor sensed by flavorant components delivered to the nose (nasal cavity) after passing through the mouth (oral cavity). The external flavor refers to a flavor sensed by flavorant components delivered to the nose (nasal cavity) without passing through the mouth (oral cavity).

When the user performs inhalation for a predetermined time and the combustion type heat source 13 burns out, or when the smoking flavor from the flavor source 16 is gone, the inhalation is completed. At this time, the ash of the combustion type heat source 13 is held at the distal end of the holder 12 without falling on the ground, and thus there is small load on the surrounding environment. Moreover, the smoke generated from the flavor inhaler 11 is significantly less as compared to conventional paper-wrapped tobaccos (cigarettes), and thus the load on the surrounding environment is small.

The flavor inhaler 11 is not limited to the above-described embodiments and can be embodied in practice by modifying the structural elements without departing from the gist of the invention. For example, the shape of the holder 12 is not limited to a cylindrical shape, but may be, for example, a square tubular shape, a tubular shape having an elliptical cross section, or a tubular shape having other polygonal cross sections (hexagonal, octagonal, etc.).

The preferred embodiments of the flavor inhaler are summarized below.

[1] A flavor inhaler comprising:

a tubular holder that extends from a mouthpiece end to a distal end;

a combustion type heat source that is provided at the distal end, contains activated carbon, and carries a first flavorant; and a flavor source that is held in the holder and carries a second flavorant, wherein the first flavorant contains at least one selected from the group consisting of anethole, 2-pinene, β-citronellol, linalyl acetate, limonene, anisaldehyde, 4-terpineol, 2-β-pinene, jasmone, sabinene, linalool, 1,8-cineole, phenethyl alcohol, and myristicin, and the second flavorant contains at least one selected from the group consisting of α-terpinene, γ-terpinene, nerol, geraniol, and decanal.

[2] The flavor inhaler according to [1], wherein the first flavorant is substantially free of any of menthol, α-terpinene, γ-terpinene, nerol, geraniol, and decanal.

[3] The flavor inhaler according to [1] or [2], wherein the second flavorant contains at least one selected from the group consisting of nerol and geraniol.

[4] The flavor inhaler according to any one of [1] to [3], wherein the second flavorant is substantially free of any of anethole, 2-pinene, β-citronellol, linalyl acetate, limonene, anisaldehyde, 4-terpineol, 2-β-pinene, jasmone, sabinene, linalool, 1,8-cineole, phenethyl alcohol, and myristicin.

[5] The flavor inhaler according to any one of [1] to [3], wherein the second flavorant is substantially free of menthol.

[6] The flavor inhaler according to any one of [1] to [5], further comprising a filter portion that is provided on a side of the mouthpiece end in the holder and includes a flavorant capsule containing a third flavorant.

[7] The flavor inhaler according to [6], wherein the third flavorant contains at least one selected from the group consisting of menthol, α-terpinene, γ-terpinene, nerol, geraniol, and decanal.

[8] The flavor inhaler according to [7], wherein the third flavorant contains menthol.

[9] The flavor inhaler according to [7], wherein the third flavorant contains at least one selected from the group consisting of α-terpinene, γ-terpinene, nerol, geraniol, and decanal, and is different from the second flavorant.

[10] The flavor inhaler according to [9], wherein the third flavorant contains at least one selected from the group consisting of α-terpinene and γ-terpinene, and is different from the second flavorant.

[11] A flavor inhaler comprising:

a tubular holder that extends from a mouthpiece end to a distal end;

a combustion type heat source that is provided at the distal end, contains activated carbon, and carries a first flavorant;

a flavor source that is held in the holder; and a filter portion that is provided on a side of the mouthpiece end in the holder and includes a flavorant capsule containing a third flavorant, wherein the first flavorant contains at least one selected from the group consisting of anethole, 2-pinene, β-citronellol, linalyl acetate, limonene, anisaldehyde, 4-terpineol, 2-β-pinene, jasmone, sabinene, linalool, 1,8-cineole, phenethyl alcohol, and myristicin, and the third flavorant contains at least one selected from the group consisting of menthol, α-terpinene, γ-terpinene, nerol, geraniol, and decanal.

[12] The flavor inhaler according to [11], wherein the third flavorant contains menthol.

[13] The flavor inhaler according to [11], wherein the third flavorant contains at least one selected from the group consisting of α-terpinene, γ-terpinene, nerol, geraniol, and decanal.

[14] The flavor inhaler according to [13], wherein the third flavorant contains at least one selected from the group consisting of α-terpinene and γ-terpinene.

[15] The flavor inhaler according to any one of [11] to [14], wherein the first flavorant is substantially free of any of menthol, α-terpinene, γ-terpinene, nerol, geraniol, and decanal.

[16] The flavor inhaler according to any one of [11] to [15], further comprising a flavor source that is held in the holder and carries a second flavorant,

[17] The flavor inhaler according to [16], wherein the second flavorant contains at least one selected from the group consisting of α-terpinene, γ-terpinene, nerol, geraniol, and decanal.

[18] The flavor inhaler according to [16] or [17], wherein the second flavorant contains at least one selected from the group consisting of nerol and geraniol.

[19] The flavor inhaler according to any one of [16] to [18], wherein the second flavorant is substantially free of any of anethole, 2-pinene, β-citronellol, linalyl acetate, limonene, anisaldehyde, 4-terpineol, 2-β-pinene, jasmone, sabinene, linalool, 1,8-cineole, phenethyl alcohol, and myristicin.

[20] The flavor inhaler according to any one of [16] to [18], wherein the second flavorant is substantially free of menthol.

[21] The flavor inhaler according to any one of [1] to [20], wherein the holder is a paper tube.

[22] The flavor inhaler according to any one of [1] to [21], further comprising aluminum adhering to an inner side of the holder.

[23] The flavor inhaler according to any one of [1] to [22], wherein the flavor source is a tobacco raw material.

[24] The flavor inhaler according to any one of [1] to [23], further comprising a cup for accommodating the flavor source therein, wherein the cup is inserted into the holder in a direction opening toward the distal end side, and comprises openings at a bottom.

[25] The flavor inhaler according to [24], wherein the cup is made of metal or paper.

[26] The flavor inhaler according to any one of [1] to [25], wherein the activated carbon has a BET specific surface area of 1300 $m^2/g$ or more.

[27] The flavor inhaler according to any one of [1] to [26], wherein the activated carbon has a BET specific surface area of 1300 $m^2/g$ or more, and 2500 $m^2/g$ or less.

[28] The flavor inhaler according to any one of [1] to [27], wherein the activated carbon has a BET specific surface area of 2000 $m^2/g$ or more, and 2500 $m^2/g$ or less.

[29] The flavor inhaler according to any one of [1] to [28], wherein the activated carbon has a BET specific surface area of 2050 $m^2/g$ or more, and 2300 $m^2/g$ or less.

[30] The flavor inhaler according to any one of [1] to [29], wherein the combustion type heat source contains the activated carbon in an amount of 30 wt % or more, and 60 wt % or less.

[31] The flavor inhaler according to any one of [1] to [30], wherein the combustion type heat source contains the activated carbon in an amount of 30 wt % or more, and 45 wt % or less.

[32] The flavor inhaler according to any one of [1] to [31], wherein the combustion type heat source includes a protrusion portion that protrudes from the distal end, and the first flavorant is carried on the protrusion portion.

[33] The flavor inhaler according to [32], wherein the protruding portion comprises a distal end surface, and the first flavorant is carried on the distal end surface.

[34] The flavor inhaler according to [33], wherein the protruding portion comprises an outer peripheral surface adjacent to the distal end surface, and the first flavorant is carried on the outer peripheral surface.

[35] The flavor inhaler according to [34], wherein the outer peripheral surface comprises an annular carrier that carries the first flavorant.

[36] The flavor inhaler according to [32], wherein the protruding portion comprises an outer peripheral surface, and the first flavorant is carried on the outer peripheral surface.

[37] The flavor inhaler according to [32], wherein the protruding portion comprises a distal end surface, and an outer peripheral surface adjacent to the distal end surface;

the combustion type heat source comprises:

a ventilation path that supplies air into the holder; and a groove that is provided in the protruding portion to be recessed from at least one of the distal end surface and the outer peripheral surface, and communicates with the ventilation path; and the first flavorant is carried on the groove.

[38] The flavor inhaler according to [37], wherein the first flavorant is carried on the distal end surface.

[39] The flavor inhaler according to [37] or [38], wherein the first flavorant is carried on the outer peripheral surface.

[40] The flavor inhaler according to [39], wherein the outer peripheral surface comprises an annular carrier that carries the first flavorant.

[41] The flavor inhaler according to any one of [37] to [40], wherein the first flavorant is carried on the ventilation path.

[42] The flavor inhaler according to any one of [1] to [41], wherein the combustion type heat source has a cylindrical shape.

[43] The flavor inhaler according to any one of [1] to [42], wherein the combustion type heat source comprises a distal end surface, a proximal end surface that faces the distal end surface, and an outer peripheral surface that connects the distal end surface and the proximal end surface, and the distal end surface comprises a chamfered portion at a portion adjacent to the outer peripheral surface.

[44] The flavor inhaler according to any one of [1] to [43], wherein the combustion type heat source comprises a protruding portion that protrudes from the distal end of the holder, and the first flavorant is not carried on the proximal end surface of the protruding portion facing the distal end surface of the protruding portion.

EXAMPLES

Example 1

Storage Test on First Flavorant

[Process of Manufacturing Combustion Type Heat Source]

After mixing 235.5 g of highly activated carbon (BET specific surface area: 2050 $m^2/g$), 323.8 g of calcium carbonate, and 28.1 g of sodium carboxymethyl cellulose, 745.3 g of water containing 5.4 g of sodium chloride was added, and further mixed. After the mixture was kneaded, extrusion molding was carried out to have a cylindrical shape having an outer diameter of 6.5 mm. The molded product obtained by the extrusion molding was dried and then cut to a length of 13 mm to obtain a primary molded product.

A drill with a diameter of 1.0 mm was used to provide a through hole having an inner diameter of 1.0 mm at the center portion of the primary molded product. Cross groove processing was applied to one end surface of the primary molded product with a diamond cutting disc.

In this manner, the combustion type heat source 13 was manufactured in which the combustion type heat source 13 has the shape illustrated in FIG. 2, contains the activated carbon having the BET specific surface area of 2050 $m^2/g$, and has the activated carbon concentration of 39.7 wt %.

[Results of Storage Test]

Various flavorants listed in Table 1 below were carried on the combustion type heat source 13 manufactured above. Storage test was performed using the combustion type heat source 13 carrying each flavorant.

Each flavorant was carried as follows. The liquid containing each flavorant was discharged (dropped) to the distal end surface 28, the first chamfered portion 34, and the inner peripheral surfaces of the groove 33 of the combustion type heat source 13 so that the flavorant was carried on the distal end surface 28, the first chamfered portion 34, and the inner peripheral surfaces of the groove 33.

The storage test was performed as follows. The combustion type heat source 13 carrying the flavorant was left in an open system at a temperature of 40° C. for 4 weeks.

After 4 weeks, the residual rate of the flavorant remaining in the combustion type heat source 13 was examined.

The amount of the flavorant remaining in the combustion type heat source was measured as follows. The combustion type heat source 13 was placed in internal standard solution-containing ethanol, and the combustion type heat source 13 was shaken for 20 hours, followed by filtering, thereby obtaining a sample solution. This sample solution was analyzed by GC/MS. In this manner, a quantitative value of the flavorant remaining in the combustion type heat source 13 was obtained.

The residual rate (wt %) was calculated based on the amount of flavorant remaining in the combustion type heat source 13, and the amount of flavorant carried on the combustion type heat source 13.

The results of the residual rate of flavorant are shown in Table 1.

TABLE 1

| Flavorant | Residual rate (after 4 weeks) |
|---|---|
| anethole | 97% |
| 2-pinene | 83% |
| β-citronellol | 80% |
| linalyl acetate | 111% |
| limonene | 91% |
| anisaldehyde | 94% |
| 4-terpineol | 100% |
| 2-β-pinene | 80% |
| jasmone | 105% |
| sabinene | 79% |
| linalool | 101% |
| 1,8-cineole | 95% |
| phenethyl alcohol | 75% |

TABLE 1-continued

| Flavorant | Residual rate (after 4 weeks) |
|---|---|
| myristicin | 76% |
| α-terpinene | 0% |
| γ-terpinene | 0% |
| nerol | 52% |
| geraniol | 38% |
| decanal | 63% |

Anethole, 2-pinene, β-citronellol, linalyl acetate, limonene, anisaldehyde, 4-terpineol, 2-β-pinene, jasmone, sabinene, linalool, 1,8-cineole, phenethyl alcohol and myristicin were stably maintained in a state of being carried on the combustion type heat source 13. In particular, anethol, 2-pinene, β-citronellol, linalyl acetate, limonene, anisaldehyde, 4-terpineol, 2-β-pinene, jasmone, linalool, and 1,8-cineole showed residual rates of 80% or more.

α-terpinene and γ-terpinene had a residual rate of 0%. Also, nerol, geraniol, and decanal showed relatively low residual rates. It is considered that these flavorants have undergone a chemical change during storage.

Example 2

Transfer Rate of First Flavorant to Mainstream Smoke

[Manufacture of Combustion Type Heat Source]

The combustion type heat source 13 was manufactured according to the same method as that described in Example 1. As a result, the combustion type heat source 13 having the shape illustrated in FIG. 2 and containing the activated carbon having the BET specific surface area of 2050 $m^2/g$ and having the activated carbon concentration of 39.7 wt % was manufactured.

(Measurement Results of Transfer Rate to Mainstream Smoke)

Anethole was carried on the combustion type heat source 13 according to the same method as that described in the Example 1. Using the combustion type heat source 13 carrying anethole, a flavor inhaler 11 shown in FIG. 1 was manufactured. Geraniol was used as the second flavorant, and menthol was used as the third flavorant.

Figure 4:
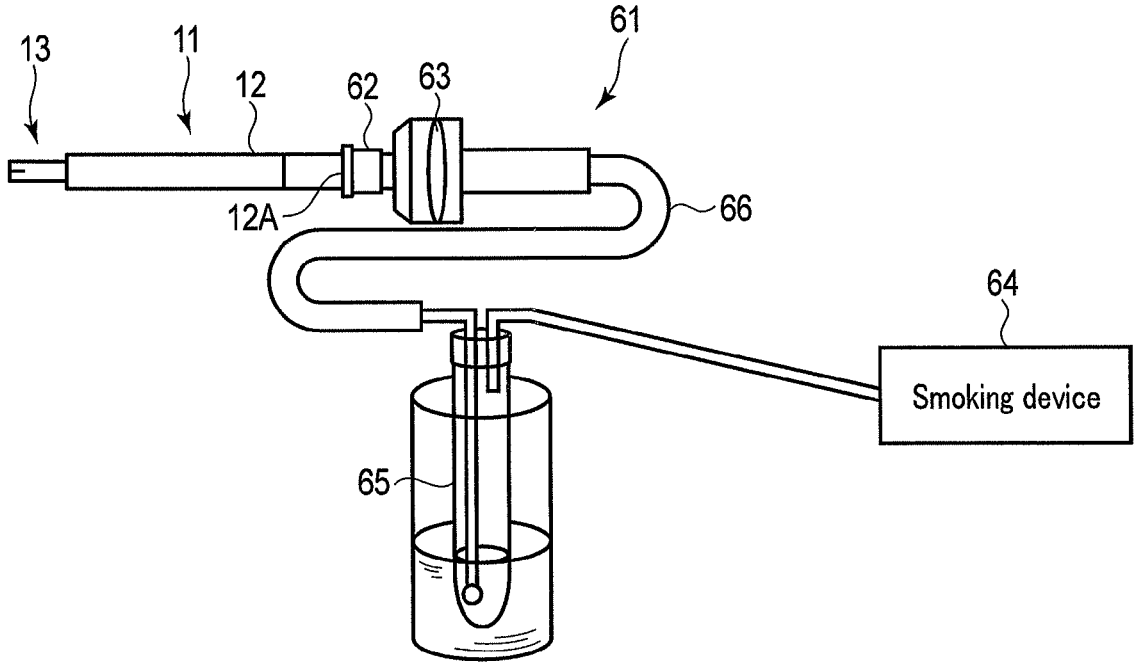
FIG. 4 is a schematic view showing a measuring device for measuring a transfer rate to a mainstream smoke.

A measuring device 61 shown in FIG. 4 was used to measure the transfer rate of the flavorant (anethole) carried on the combustion type heat source 13 to the mainstream smoke. The measuring device 61 includes: a holder portion 62 (cigarette holder) holding the mouthpiece end 12A of the flavor inhaler 11; a Cambridge filter 63 provided on the downstream side of the holder portion 62; an impinger 65 provided on the downstream side of the Cambridge filter 63; a tube 66 connecting an automatic smoking device 64 and the impinger 65; and the automatic smoking device 64 provided on the downstream side of the impinger 65. Internal standard solution-containing methanol is held inside the impinger 65.

The transfer rate of the flavorant to the mainstream smoke was measured by the following procedure.

The flavor inhaler 11 was smoked using the automatic smoking device 64 under the following conditions.

TABLE 2

| Profile | Interval | Volume | Duration |
|---|---|---|---|
| ISO Bell Shape | 30 | 55.0 | 2.0 |

The smoking conditions of the automatic smoking device 64 were set as shown in the above table. For example, it was set in a manner that when the horizontal axis represents the time and the vertical axis represents the pressure drop, the curve of the pressure drop in the holder 12 of the flavor inhaler 11 by one-time puff inhalation has a so-called bell shape (pressure drop was the highest at an intermediate point in the inhalation time). As shown in the above table, the time interval of the start of the puff was 30 seconds. The puff duration (Duration) was 2 seconds. Thus, under this smoking condition, the puff duration and the non-puff duration were alternately repeated, such as 2 seconds of puff duration→28 seconds of non-puff duration→2 seconds of puff duration→28 seconds of non-puff duration. The volume of the smoke inhaled by one puff was 55 ml. The number of puffs was set to 15 times (12 times where red heat of the combustion type heat source was confirmed+3 times).

Smoking was carried out under such smoking conditions, and the smoke was collected using the Cambridge filter 63. The Cambridge filter 63 was placed in internal standard solution-containing methanol, the Cambridge filter 63 was crushed, followed by shaking and filtering, thereby obtaining a sample solution. This sample solution was analyzed by GC/MS. As a result, a quantitative value of the flavorant collected by the Cambridge filter 63 was obtained.

Similarly, the smoke that had passed through the Cambridge filter 63 was also collected by the impinger 65 which contains internal standard solution-containing methanol. The sample solution obtained from the impinger 65 was analyzed by GC/MS. As a result, a quantitative value of the flavorant collected by the impinger 65 was obtained.

Furthermore, the smoke that had adhered to the inner wall of the tube 66 was collected in the following manner. First, the tube 66 was cut finely, and then placed in internal standard solution-containing methanol. This was shaken and filtered to obtain a sample solution. This sample solution was analyzed by GC/MS. As a result, a quantitative value of the flavorant adhering to the inner wall of the tube 66 was obtained. GC/MS was carried out under the conditions shown in Table 3 below.

TABLE 3

| | |
|---|---|
| Column | DB-FFAP 30 m × 0.25 mmID × 0.25 μm |
| Oven Temp | 40° C. (7 min)-4° C./min-200° C.-20° C./min-240° C. (11 min) |
| Inlet | Split/Splitless |
| Injection | 1 μL, 240° C., Split 10:1 |
| Flow rate | 1 mL/min, Constant Flow |
| Transfer Line Temp. | 240° C. |
| MS Source Temp. | 230° C. |
| MS Quadrupole Temp. | 150° C. |

The sum of the quantitative value of the flavorant collected by the Cambridge filter 63, the quantitative value of the flavorant collected by the impinger 65, and the quantitative value of the flavorant adhering to the inner wall of the tube 66 was determined as a weight of the flavorant transferred to the mainstream smoke. The transfer rate of the flavorant to the mainstream smoke can be calculated by the following equation.

(transfer rate) (%)={(quantitative value of flavorant collected by Cambridge filter 63)+(quantitative value of flavorant collected by impinger 65)+(quantitative value of flavorant adhering to inner wall of tube 66)}/(total weight of flavorant in combustion type heat source 13) Equation (1)

As an example, the result of the transfer rate obtained in such a manner when anethole was used as a flavorant will be described below.

The total weight of the flavorant carried on the combustion type heat source 13 was 3075 μg (corresponding to the denominator of Equation (1)). On the other hand, the total weight of the flavorant transferred to the mainstream smoke was 42.77 μg (corresponding to the numerator of Equation (1)). Therefore, when anethole was used as a flavorant, the transfer rate of anethole to the mainstream smoke was 1.39% according to Equation (1).

This result demonstrates that the first flavorant carried by the combustion type heat source transfers to mainstream smoke, and can contribute to the flavor sensed by the user, together with the second flavorant carried by the flavor source and the third flavorant contained in the flavorant capsule.

Example 3

Example Using Menthol as First Flavorant

The combustion type heat source 13 was manufactured according to the same method as that described in Example 1. As a result, the combustion type heat source 13 having the shape illustrated in FIG. 2 and containing the activated carbon having the BET specific surface area of 2050 $m^2/g$ and having the activated carbon concentration of 39.7 wt % was manufactured.

Menthol was carried on the combustion type heat source 13 according to the same manner as that described in Example 1. Using the combustion type heat source 13 carrying menthol, a flavor inhaler 11 (comparative example) shown in FIG. 1 was manufactured.

When the present inventors inhaled with the flavor inhaler 11 (comparative example), they sensed a metal-like undesirable flavor.

Example 4

Sensory Evaluation of First Flavorant

[Manufacture of Combustion Type Heat Source]

The combustion type heat source 13 was manufactured according to the same method as that described in Example 1. As a result, the combustion type heat source 13 having the shape illustrated in FIG. 2 and containing activated carbon having a BET specific surface area of 2050 $m^2/g$ and having an activated carbon concentration of 39.7 wt % was manufactured.

Anethole was carried on the combustion type heat source 13 according to the same manner as that described in Example 1. Using the combustion type heat source 13 carrying the flavorant, a flavor inhaler 11 shown in FIG. 1 was manufactured. Geraniol was used as the second flavorant, and menthol was used as the third flavorant.

The present inventors were able to sense the flavor (external flavor) diffused from the flavorant carried by the combustion type heat source 13, prior to inhalation. The present inventors were also able to sense the flavor (external flavor) diffused from the flavorant before and after igniting the combustion type heat source 13 while holding the flavor inhaler 11 with the lips.

When inhaling with the flavor inhaler 11, the flavor originating from the first flavorant carried by the combustion type heat source 13, the second flavorant carried by the flavor source 16, and the flavor source 16 can be sensed, and no undesirable flavor was sensed. By crushing the capsule 22 with the fingers, it was possible to change the smoking flavor of mainstream smoke by releasing the third flavorant contained in the capsule 22.

The invention claimed is:

1. A flavor inhaler comprising:

a tubular holder that extends from a mouthpiece end to a distal end;

a combustion type heat source that is configured to plug an opening at the distal end of the tubular holder, and contains:

a molded product that constitutes a main body of the combustion type heat source, and formed by integrally molding a material containing activated carbon into a cylindrical shape, wherein the molded product has a protrusion portion protruding from the distal end of the tubular holder, a distal end surface of the protruding portion, an outer peripheral surface adjacent to the distal end surface and a proximal end surface opposite to the distal end surface; and a first flavorant adsorbed on the protrusion portion distal end surface and in an annular band on the outer peripheral surface of the molded product, wherein an amount of the first flavorant contained in the distal end surface of the molded product is greater than an amount of the first flavorant contained in the proximal end surface of the molded product and the first flavorant is adsorbed inside the molded product so that a gradient of the first flavorant decreases from the distal end surface of the molded product toward the proximal end surface of the molded product and gradually decreases concentrically from the outer peripheral surface toward a central axis of the molded product;

a flavor source that is held in the holder and provided downstream of the combustion type heat source at a position adjacent to the combustion type heat source, and carries a second flavorant; and a filter portion that is provided downstream of the flavor source and on a side of the mouthpiece end in the holder, wherein the first flavorant contains at least one selected from the group consisting of anethole, 2 pinene, β citronellol, linalyl acetate, limonene, anisaldehyde, 4 terpineol, 2-β-pinene, jasmone, sabinene, linalool, 1,8 cineole, phenethyl alcohol, and myristicin, and the second flavorant contains at least one selected from the group consisting of α-terpinene, γ-terpinene, nerol, geraniol, and decanal, wherein the first flavorant is substantially free of any of menthol, α terpinene, γ-terpinene, nerol, geraniol, and decanal.

2. The flavor inhaler according to claim 1, wherein the second flavorant contains at least one selected from the group consisting of nerol and geraniol.

3. The flavor inhaler according to claim 1, wherein the second flavorant is substantially free of any of anethole, 2-pinene, β-citronellol, linalyl acetate, limonene, anisaldehyde, 4-terpineol, 2 β pinene, jasmone, sabinene, linalool, 1,8-cineole, phenethyl alcohol, and myristicin.

4. The flavor inhaler according to claim 1, wherein the second flavorant is substantially free of menthol.

5. The flavor inhaler according to claim 1, further comprising a filter portion that is provided on a side of the mouthpiece end in the holder and includes a flavorant capsule containing a third flavorant.

6. The flavor inhaler according to claim 5, wherein the third flavorant contains at least one selected from the group consisting of menthol, α-terpinene, γ-terpinene, nerol, geraniol, and decanal.

7. A flavor inhaler comprising:

a tubular holder that extends from a mouthpiece end to a distal end;

a combustion type heat source that is configured to plug an opening at the distal end of the tubular holder, and contains:

a molded product that constitutes a main body of the combustion type heat source, and formed by integrally molding a material containing activated carbon into a cylindrical shape, wherein the molded product has a protrusion portion protruding from the distal end of the tubular holder, a distal end surface of the protruding portion, an outer peripheral surface adjacent to the distal end surface and a proximal end surface opposite to the distal end surface; and a first flavorant adsorbed on the protrusion portion distal end surface and in an annular band on the outer peripheral surface of the molded product, wherein an amount of the first flavorant contained in the distal end surface of the molded product is greater than an amount of the first flavorant contained in the proximal end surface of the molded product and the first flavorant is adsorbed inside the molded product so that a gradient of the first flavorant decreases from the distal end surface toward the proximal end surface and gradually decreases concentrically from the outer peripheral surface toward a central axis of the molded product;

a flavor source that is held in the holder and provided downstream of the combustion type heat source at a position adjacent to the combustion type heat source; and a filter portion that is provided downstream of the flavor source and on a side of the mouthpiece end in the holder and includes a flavorant capsule containing a third flavorant, wherein the first flavorant contains at least one selected from the group consisting of anethole, 2 pinene, β citronellol, linalyl acetate, limonene, anisaldehyde, 4 terpineol, 2-β-pinene, jasmone, sabinene, linalool, 1,8 cineole, phenethyl alcohol, and myristicin, and the third flavorant contains at least one selected from the group consisting of menthol, α-terpinene, γ-terpinene, nerol, geraniol, and decanal, wherein the first flavorant is substantially free of any of menthol, α terpinene, γ-terpinene, nerol, geraniol, and decanal.

8. The flavor inhaler according to claim 6, wherein the third flavorant contains menthol.

9. The flavor inhaler according to claim 7, wherein the third flavorant contains menthol.

10. The flavor inhaler according to claim 6, wherein the third flavorant contains at least one selected from the group consisting of α-terpinene, γ-terpinene, nerol, geraniol, and decanal, and is different from the second flavorant.

11. The flavor inhaler according to claim 1, wherein the activated carbon has a BET specific surface area of 1300 m2/g or more.

* * * * *